US008087942B2

(12) United States Patent
Chen

(10) Patent No.: US 8,087,942 B2
(45) Date of Patent: Jan. 3, 2012

(54) BOARD-TO-BOARD CONNECTOR ASSEMBLY

(75) Inventor: Chung-Yu Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 694 days.

(21) Appl. No.: 12/289,550

(22) Filed: Oct. 30, 2008

(65) Prior Publication Data

US 2009/0116891 A1 May 7, 2009

(51) Int. Cl.
*H01R 12/00* (2006.01)

(52) U.S. Cl. ..... 439/74

(58) Field of Classification Search ..... 439/74, 439/65, 81, 83, 660, 346
See application file for complete search history.

(56) References Cited

U.S. PATENT DOCUMENTS

| | | | | |
|---|---|---|---|---|
| 7,484,969 | B2 * | 2/2009 | Shiu | 439/74 |
| 7,637,786 | B2 * | 12/2009 | Hoshino et al. | 439/660 |
| 7,758,352 | B2 * | 7/2010 | Zeng | 439/74 |
| 2009/0061655 | A1 * | 3/2009 | Miyazaki et al. | 439/74 |

* cited by examiner

*Primary Examiner* — Jean Duverne
(74) *Attorney, Agent, or Firm* — Rosenberg, Klein & Lee

(57) ABSTRACT

A board-to-board connector assembly includes a receptacle connector and a plug connector. The receptacle connector has a receptacle housing, a plurality of first terminals disposed in the receptacle housing, and at least one first fixing member mounted to the receptacle housing. The first fixing member has a first base portion, an elastic portion bending toward one side and then extending downward from a top of the first base portion. An outside portion of the elastic portion defines a fixing cavity opposite to the first base portion. The plug connector has a plug housing mated with the receptacle housing, a plurality of second terminals disposed in the plug housing and contacting the corresponding first terminals, and at least one second fixing member mounted in the plug housing and defining at least one fixing portion which is buckled into the fixing cavity of the corresponding first fixing member.

8 Claims, 4 Drawing Sheets

BOARD-TO-BOARD CONNECTOR ASSEMBLY

BACKGROUND OF THE INVENTION

1. Field of the Invention

The present invention generally relates to an electrical connector, and more particularly to a board-to-board connector assembly.

2. The Related Art

Generally, a board-to-board connector assembly includes a receptacle connector having a plurality of first terminals disposed therein and a plug connector having a plurality of second terminals disposed therein. In use, the first terminals are soldered to a female printed circuit board and the second terminals are soldered to a male printed circuit board. When the plug connector is engaged with the receptacle connector, the second terminals connect with the first terminals to make the printed circuit boards electrically connected with each other. However, the plug connector is engaged with the receptacle connector only via the terminals abutting against each other, so the plug connector is apt to fall off from the receptacle connector under shaking. Furthermore, it is difficult to judge whether the plug connector is rightly engaged with the receptacle connector or not.

SUMMARY OF THE INVENTION

An object of the present invention is to provide a board-to-board connector assembly including a receptacle connector and a plug connector. The receptacle connector has a receptacle housing defining a first receiving recess at a top thereof and four sidewalls formed around the first receiving recess, a plurality of first terminals disposed in the receptacle housing, and at least one first fixing member having a first base portion disposed in the sidewall. A top of the first base portion bends toward one side and then extends downward to form an elastic portion stretching into the first receiving recess. An outside portion of the elastic portion defines a fixing cavity opposite to the first base portion. The plug connector has a plug housing received in the first receiving recess of the receptacle housing, a plurality of second terminals disposed in the plug housing and contacting the corresponding first terminals, and at least one second fixing member having a second base portion disposed in the plug housing. The second base portion protrudes outward to form at least one fixing portion stretching out of the plug housing and buckled into the fixing cavity of the corresponding first fixing member.

As described above, the fixing cavity of the first fixing member and the fixing portion of the second fixing member are defined to buckle with each other so as to ensure that the receptacle connector and the plug connector can be engaged with each other firmly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
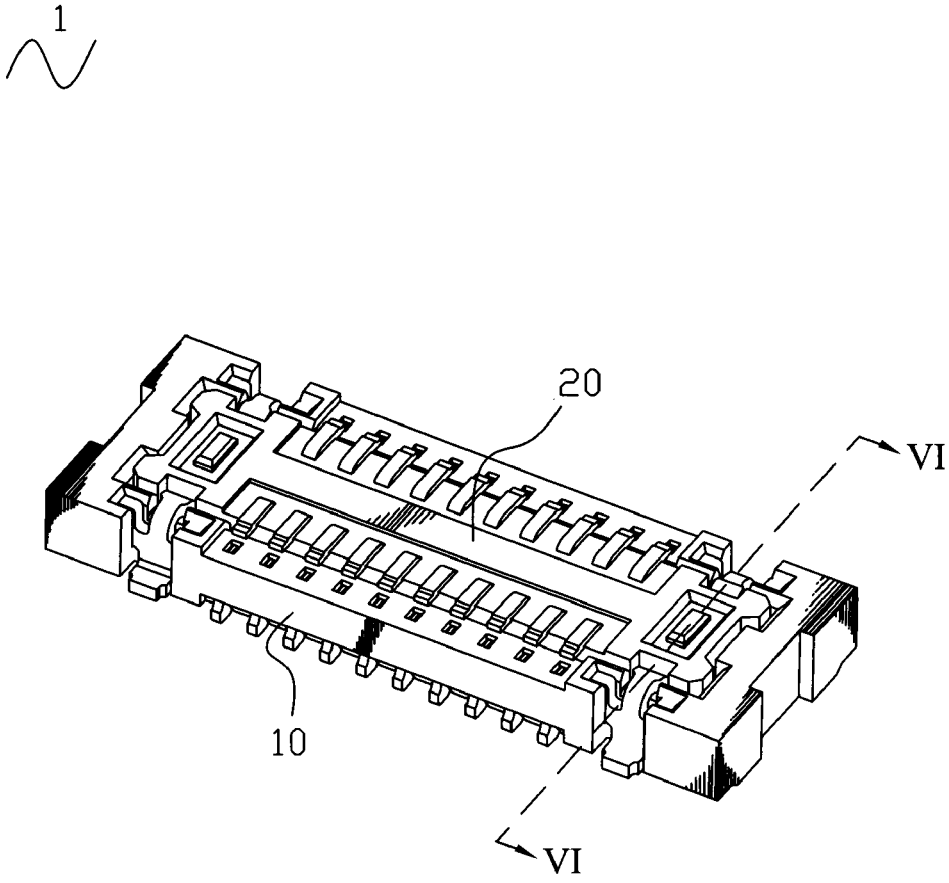
FIG. 1 is a perspective view of a board-to-board connector assembly in accordance with the present invention.
Figure 2:
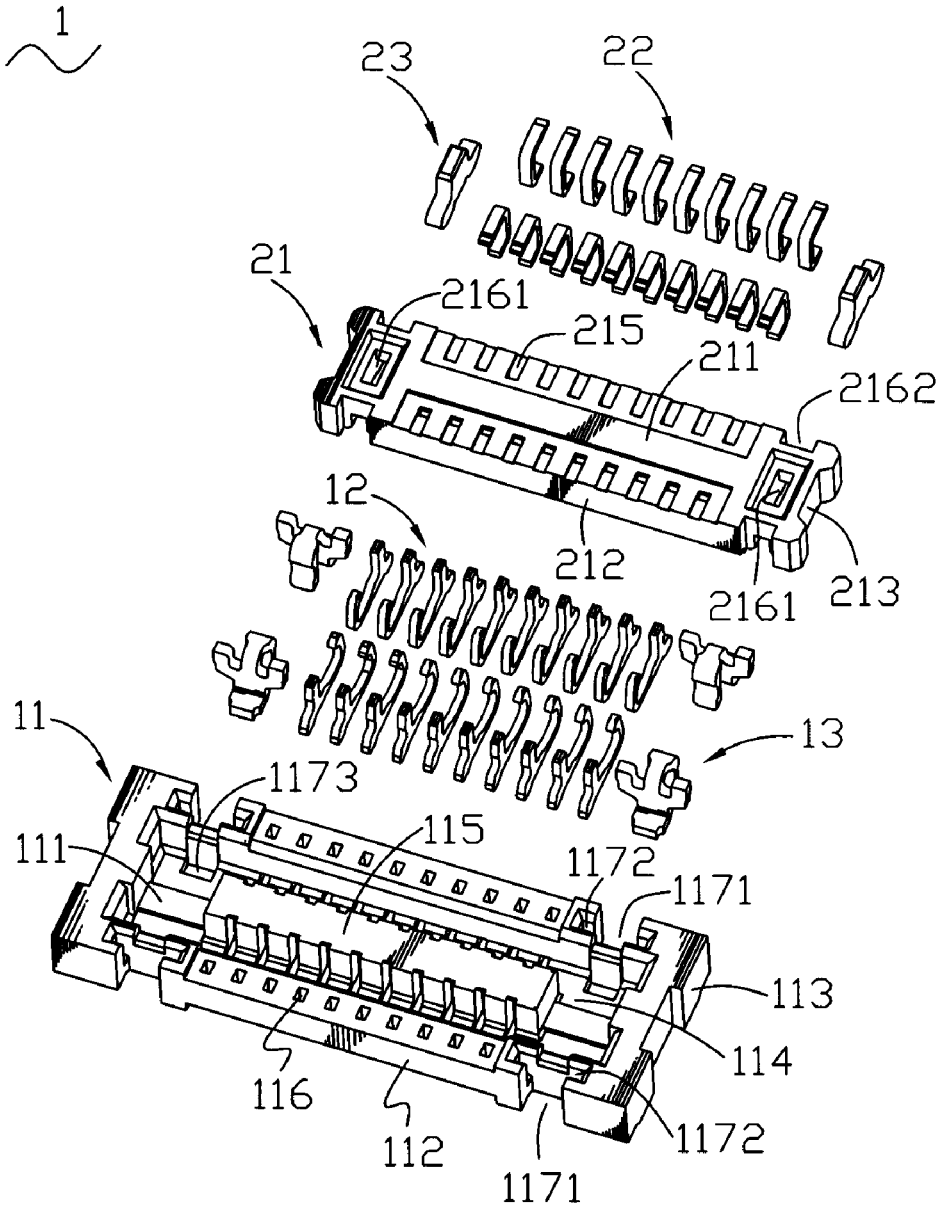
FIG. 2 is an exploded perspective view of the board-to-board connector assembly of FIG. 1.

Referring to FIGS. 1 and 2, a board-to-board connector assembly 1 in accordance with the present invention includes a receptacle connector 10 and a plug connector 20 which are mounted to a female and a male printed circuit boards (not shown) to make the printed circuit boards electrically connected with each other.

Figure 3:
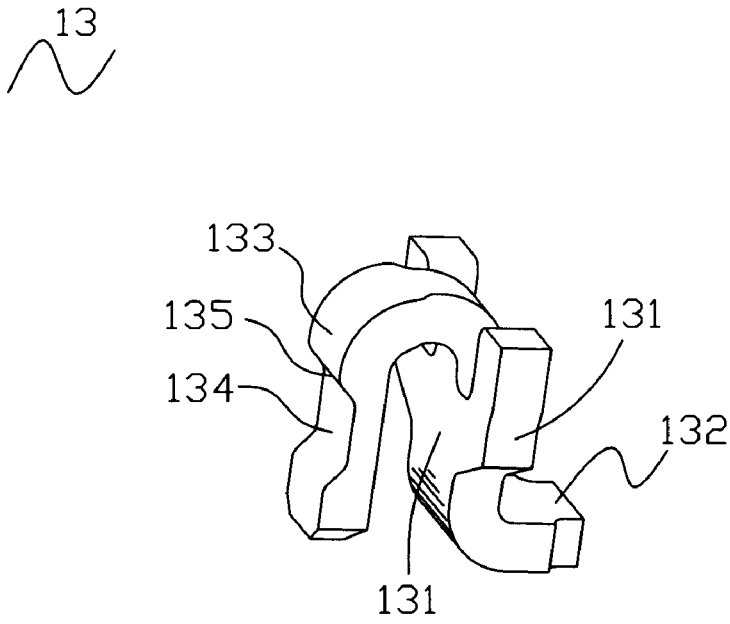
FIG. 3 is a perspective view of a first fixing member of the board-to-board connector assembly of FIG. 1.

Referring to FIGS. 2 and 3, the receptacle connector 10 includes a receptacle housing 11, a plurality of first terminals 12 and four first fixing members 13 disposed in the receptacle housing 11 respectively.

The receptacle housing 11 is rectangular to have a first base board 111. Two opposite sides of the first base board 111 protrude upward to form a pair of first sidewalls 112 extending longwise. Two opposite ends of the first base board 111 protrude upward to form a pair of second sidewalls 113. A first receiving recess 114 is defined among the first sidewalls 112, the second sidewalls 113 and the first base board 111. A middle of the first base board 111 protrudes upward into the first receiving recess 114 to form a rib 115 extending longwise. Two ends of the rib 115 are apart from the corresponding second sidewalls 113. Each of the first sidewalls 112 defines a plurality of first cavities 116 arranged at regular intervals along a longwise direction. Bottom ends of the first cavities 116 extend to the first base board 111 and two opposite sides of the rib 115 to communicate with the first receiving recess 114. Two ends of an outside of each of the first sidewalls 112 respectively define a fixing groove 1171 penetrating from top to bottom. An inside of each of the fixing grooves 1171 extends toward two sides to respectively form a fixing fillister 1172 at top. Each end of two sides of the first base board 111 defines a fixing hole 1173 back to the corresponding fixing groove 1171 and communicating with the first receiving recess 114.

Each of the first fixing members 13 has a first base portion 131 disposed vertically. A middle of a bottom of the first base portion 131 extends downward and then bends toward one side to form a first soldering portion 132. A middle of a top of the first base portion 131 bends toward the other side opposite to the first soldering portion 132 and then extends downward to form an elastic portion 133. An outside of the elastic portion 133 defines a fixing cavity 134 back to the first base portion 131. A top side of the fixing cavity 134 defines a smooth guiding surface 135 connecting with the outside of the elastic portion 133.

When the receptacle connector 10 is assembled, the first terminals 12 are received in the corresponding first cavities 116 and soldered to the female printed circuit board to electrically connect with each other. The first fixing members 13 are mounted to two ends of the corresponding first sidewalls 112. The first base portion 131 and the first soldering portion 132 are received in the fixing groove 1171. Two free ends of the first base portion 131 are inserted in the fixing fillisters 1172. The elastic portion 133 stretches into the first receiving recess 114 and a bottom end thereof is inserted in the corresponding fixing hole 1173. The first soldering portions 132 are soldered to the female printed circuit board for ensuring that the first terminals 12 electrically connect with the female printed circuit board firmly.

Figure 4:
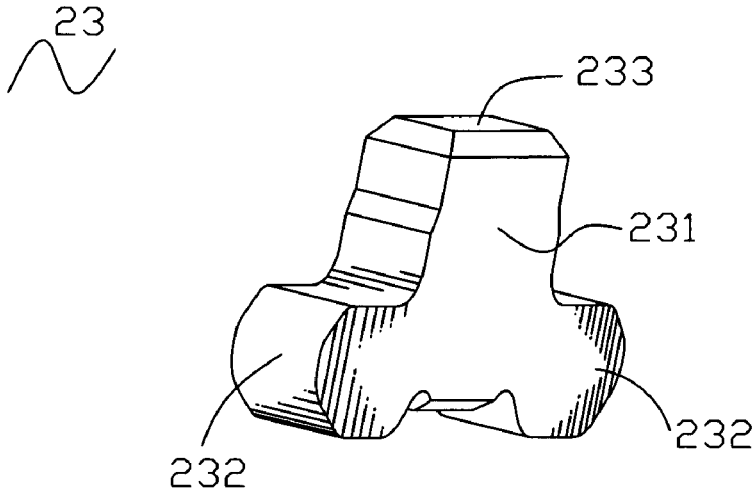
FIG. 4 is a perspective view of a second fixing member of the board-to-board connector assembly of FIG. 1.
Figure 5:
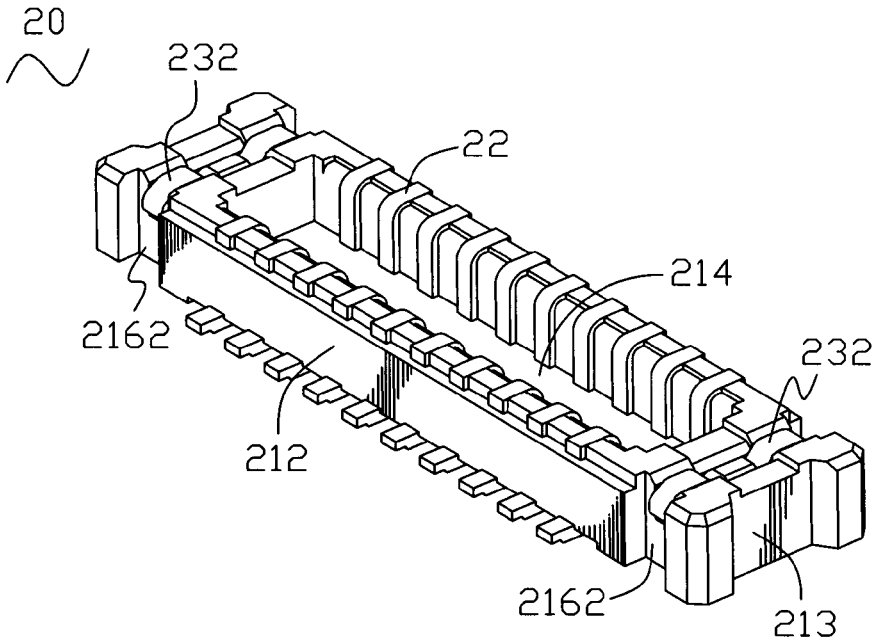
FIG. 5 is a perspective view of a plug connector of the board-to-board connector assembly of FIG. 1.

Referring to FIGS. 2, 4 and 5, the plug connector 20 includes a plug housing 21 mated with the receptacle housing 11, a plurality of second terminals 22 and two second fixing members 23 disposed in the plug housing 21 respectively.

The plug housing 21 is rectangular to have a second base board 211. Two opposite sides of the second base board 211 protrude downward to form a pair of third sidewalls 212 extending longwise. Two opposite ends of the second base board 211 protrude downward to form a pair of fourth sidewalls 213. A second receiving recess 214 is defined among the third sidewalls 212, the fourth sidewalls 213 and the second base board 211. Each of the third sidewalls 212 defines a plurality of second cavities 215 arranged at regular intervals along a longwise direction and communicating with the second receiving recess 214. Each of the fourth sidewalls 213 longitudinally defines a fixing perforation 2161 penetrating from top to bottom. A front outside and a rear outside of the fourth sidewall 213 respectively define a fixing opening 2162 penetrating from top to bottom and communicating with the fixing perforation 2161 at bottom.

Each of the second fixing members 23 has a second base portion 231 disposed vertically. A bottom of the second base portion 231 protrudes forward and rearward to form a pair of fixing portions 232. A top of the second base portion 231 defines a second soldering portion 233.

When the plug connector 20 is assembled, the second terminals 22 are received in the corresponding second cavities 215 and soldered to the male printed circuit board to electrically connect with each other. The second fixing members 23 are mounted in the corresponding fourth sidewalls 213. The second base portion 231 is received in the fixing perforation 2161 and the fixing portions 232 stretch into the corresponding fixing openings 2162. The second soldering portion 233 stretches out of the fixing perforation 2161 and is soldered to the male printed circuit board for ensuring that the second terminals 22 electrically connect with the male printed circuit board firmly.

Figure 6:
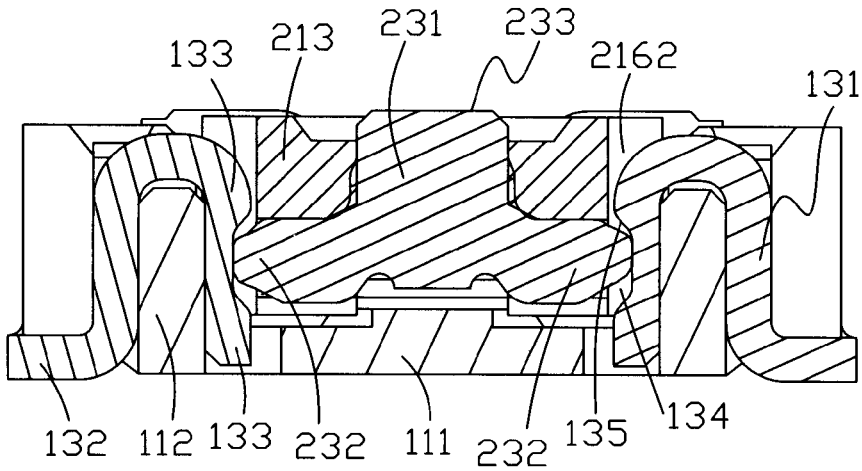
FIG. 6 is a cross-sectional view of the board-to-board connector assembly along line VI-VI of FIG. 1.

Referring to FIG. 1 and FIG. 6, when the plug connector 20 is engaged with the receptacle connector 10, the plug connector 20 is received in the first receiving recess 114 of the receptacle connector 10. The rib 115 is inserted in the second receiving recess 214. The elastic portion 133 is received in the corresponding fixing opening 2162 and the fixing portion 232 is buckled into the corresponding fixing cavity 134, whereby the plug connector 20 is engaged with the receptacle connector 10 firmly. The first terminals 12 electrically connect with the corresponding second terminals 22 for making the printed circuit boards electrically connected with each other. In the process of the plug connector 20 inserted into the receptacle connector 10, the fixing portion 232 moves downward against the corresponding elastic portion 133 until that the fixing portion 232 is buckled into the corresponding fixing cavity 134. At this time, the plug connector 20 is completely engaged with the receptacle connector 10. If the plug connector 20 is stopped pushing downward before the fixing portion 232 contacts the corresponding guiding surface 135, the plug connector 20 will rebound upward out of the receptacle connector 10 because of the elasticity acted on the fixing portion 232 by the corresponding elastic portion 133. Therefore, whether the plug connector 20 is rightly engaged with the receptacle connector 10 can be judged easily. While the plug connector 20 is withdrawn from the receptacle connector 10, the fixing portion 232 moves upward along the corresponding guiding surface 135.

As described above, the fixing cavities 134 of the first fixing members 13 and the fixing portions 232 of the second fixing members 23 are defined to buckle with each other so as to ensure that the receptacle connector 10 and the plug connector 20 can be engaged with each other firmly. Furthermore, by the cooperation from the elastic portions 133 and the corresponding fixing portions 232, it will be easy to judge whether the plug connector 20 is rightly inserted in the receptacle connector 10 or not.

What is claimed is:

1. A board-to-board connector assembly, comprising:

a receptacle connector having a receptacle housing defining a first receiving recess at a top thereof and four sidewalls formed around the first receiving recess, a plurality of first terminals disposed in the receptacle housing, and at least one first fixing member having a first base portion disposed in the sidewall, a top of the first base portion bending toward one side and then extending downward to form an elastic portion stretching into the first receiving recess, an outside portion of the elastic portion defining a fixing cavity opposite to the first base portion; and a plug connector having a plug housing received in the first receiving recess of the receptacle housing, a plurality of second terminals disposed in the plug housing and contacting the corresponding first terminals, and at least one second fixing member having a second base portion disposed in the plug housing, the second base portion protruding outward to form at least one fixing portion stretching out of the plug housing and buckled into the corresponding fixing cavity of the corresponding first fixing member.

2. The board-to-board connector assembly as claimed in claim 1, wherein a top of the fixing cavity defines a smooth guiding surface connecting with the fixing cavity.

3. The board-to-board connector assembly as claimed in claim 1, wherein a bottom of the first base portion bends toward the other side opposite to the elastic portion to form a first soldering portion.

4. The board-to-board connector assembly as claimed in claim 1, wherein the sidewall corresponding to the first fixing member defines at least one fixing groove for receiving the first base portion therein, the receptacle housing defines at least one fixing hole for receiving a bottom end of the elastic portion therein.

5. The board-to-board connector assembly as claimed in claim 1, wherein a top of the second base portion defines a second soldering portion.

6. The board-to-board connector assembly as claimed in claim 1, wherein the plug housing defines at least one fixing perforation for receiving the second base portion therein, an outside of the plug housing defines at least one fixing opening communicating with the corresponding fixing perforation for receiving the elastic portion of the first fixing member therein, the fixing portion of the second fixing member stretches into the corresponding fixing opening to be buckled into the fixing cavity of the first fixing member.

7. The board-to-board connector assembly as claimed in claim 1, wherein the sidewalls includes two first sidewalls at two opposite sides of the first receiving recess, a pair of the first fixing members are respectively mounted at two ends of each of the first sidewalls, a pair of the second fixing members are respectively mounted in two opposite ends of the plug housing, the fixing portions are formed by protruding outward from a bottom of the second base portion for buckling into the fixing cavities of the corresponding two first fixing members.

8. The board-to-board connector assembly as claimed in claim 1, wherein the receptacle housing further defines a rib protruding upward into the first receiving recess, the plug housing defines a second receiving recess at a bottom thereof for receiving the rib therein.

* * * * *